US008163346B2

(12) United States Patent
Johnson et al.

(10) Patent No.: US 8,163,346 B2
(45) Date of Patent: Apr. 24, 2012

(54) SYSTEM AND METHOD FOR MARKING HONEYCOMBS AND ASSOCIATING MANUFACTURING DATA THEREWITH

(75) Inventors: L Urdenis Johnson, Tyrone, PA (US); James Francis King, Jr., Corning, NY (US)

(73) Assignee: Corning Incorporated, Corning, NY (US)

( * ) Notice: Subject to any disclaimer, the term of this patent is extended or adjusted under 35 U.S.C. 154(b) by 741 days.

(21) Appl. No.: 12/259,488

(22) Filed: Oct. 28, 2008

(65) Prior Publication Data

US 2009/0110829 A1 Apr. 30, 2009

Related U.S. Application Data

(60) Provisional application No. 61/001,270, filed on Oct. 31, 2007.

(51) Int. Cl.
*B05D 1/26* (2006.01)

(52) U.S. Cl. ..... 427/287; 427/256; 502/439

(58) Field of Classification Search ..... 427/256, 427/287; 502/439

See application file for complete search history.

(56) References Cited

U.S. PATENT DOCUMENTS

| | | | | |
|---|---|---|---|---|
| 7,083,489 | B2 * | 8/2006 | Tsuji et al. | 445/23 |
| 2005/0082705 | A1 * | 4/2005 | Adriaansen et al. | 264/40.1 |
| 2007/0148403 | A1 * | 6/2007 | Yamamura et al. | 428/116 |

* cited by examiner

*Primary Examiner* — Frederick Parker

(74) *Attorney, Agent, or Firm* — Randall S. Wayland; Joseph M. Homa; Matthew J. Mason

(57) ABSTRACT

Both a system and method for marking honeycomb structures is provided. The system includes a printing station having a print head moveable relative to a log that prints an identification mark for each structure to be cut from the log; an elevation mechanism that positions the log relative to the printing station, sensors for determining a distance between the print head and log; and a length measuring sensor. A processor is connected to the printing station, elevation mechanism, and length measuring sensor which (a) associates an identification code with the log, (b) generates a separate identification mark for each honeycomb structure to be cut from the log, (c) controls the elevation mechanism to place the log at a desired location relative to the print head of the printing station, and (d) receives length data from the length sensor. The processor then determines cut locations for the log that define the ends of the green body honeycomb structures to be cut, and directs the printing station to print one of the identification marks on a location along the length of said log corresponding to one of said structures defined between the cut locations. A method of associating the honeycomb structures with manufacturing data is also provided.

15 Claims, 3 Drawing Sheets

SYSTEM AND METHOD FOR MARKING HONEYCOMBS AND ASSOCIATING MANUFACTURING DATA THEREWITH

RELATED APPLICATIONS

This application claims the benefit of U.S. Provisional Application No. 61/001,270 filed Oct. 31, 2007, entitled "System and Method for Marking Honeycombs and Associating Manufacturing Data Therewith."

FIELD

This invention generally relates to marking honeycomb structures, and is specifically concerned with a system and method for printing bar codes on honeycomb structures.

BACKGROUND

Ceramic honeycomb structures are widely used as anti-pollutant devices in the exhaust systems of automotive vehicles, both as catalytic converter substrates in automobiles, and diesel particulate filters in diesel-powered vehicles. In both applications, the ceramic honeycomb structures are formed from a matrix of thin ceramic webs which define a plurality of parallel, gas conducting channels. To reduce the pressure drop that the exhaust gases create when flowing through the honeycomb structure, the web walls are rendered quite thin, i.e. on the order 2-30 mils, depending upon whether the structures are to be used a catalytic converters or diesel particulate filters. In either case, the matrix of cells is surrounded by an outer skin which may be also quite thin.

In the first steps of manufacturing such substrates, generally the ceramic-forming ingredients are mixed together with a binder and liquid vehicle to form a paste-like substance which is extruded into a green body honeycomb "log." These green body logs are next conveyed through a drying station where they are subjected to microwaves, radio-frequency waves or induction currents to set or gel the binder. The log-like honeycomb extrusion may then be cut into segments along its longitudinal axis to form individual green body honeycomb structures, which are then loaded into a kiln. The honeycomb structures are fired at temperatures of typically 1300° C. or higher in order to sinter the batch constituent particles present in the extruded material into a fired ceramic honeycomb structure. The resulting fired ceramic honeycomb structures may then be subjected to a number of other manufacturing steps (such as plugging, washcoating, further firing steps, and packaging) before being rendered into a final product.

Due to the thinness of the outer skin and the inner cell-forming webs, the honeycomb structures may be relatively fragile and subject to damage. This is particularly true in the first steps of manufacture, when the web matrix and outer skin is in a green body state, being formed from a dried "clay" of unfused, particulate ceramic-forming ingredients held together by an organic binder. However, certain irregularities can also occur to the substrates during subsequent manufacturing steps from the thermal stresses that the unfinished ceramic structures may undergo during the firing process, and the necessary subsequent mechanical handling of the fired bodies as they are converted into finished products. Such irregularities in the structures may take the form of internal cracks and voids, chips and dents, and separations between the outer skin and the inner matrix of webs.

To reduce the occurrence of such irregularities, it would be desirable to have a quality control procedure which allowed the manufacturer to reliably trace any defective ceramic honeycomb structure back to the specific factory, extruder, dryer, kiln, and batch ingredients that it originated from. Such a procedure would allow the manufacturer to review the particular manufacturing parameters used to fabricate the honeycomb structure and to modify its manufacturing operation in order to reduce the occurrence of such irregularities in future articles. Accordingly, it is a known procedure to mark, after the final firing or heating step, finished ceramic honeycomb structures with marks containing manufacturing information so that remedial manufacturing operations may be implemented in the event of irregularities.

Unfortunately, the applicants have observed that such a marking procedure does not reliably result in an accurate recovery of the manufacturing information associated with a particular ceramic honeycomb structure. In particular, the applicants have observed that subsequent to the manufacture of the green bodies of such structures, different batches of ceramic structures come from different kilns necessarily become mixed together in order to efficiently implement other stages of the fabrication process. Additionally, different unfinished ceramic structures may be removed from one or more manufacturing loops, put into storage, and then later reintroduced into another manufacturing loop. Hence a quality control process where manufacturing information is printed on the finished ceramic honeycomb structures may not accurately reflect the actual manufacturing conditions and history of the structures, as structures which end up adjacent to one another in the final stages of manufacturing might have quite different manufacturing histories.

SUMMARY

Generally speaking, the invention is both a system and method for marking a honeycomb structure cut from an extruded log of ceramic-forming ingredients. To this end, the system of the invention comprises a printing station having a print head that is moveable relative to the log and that prints a separate identification mark for each green body structure to be cut from the log; a positioning station that positions the log relative to the printing station, and that includes sensors for determining a distance between the print head and the log; and a length measuring sensor that measures a length of the log.

A processor is connected to the printing station, positioning station, and length measuring sensor which (a) associates an identification code with the log, (b) generates a separate identification mark for each structure to be cut from the log, (c) controls the positioning station to place the log at a desired location relative to the print head of the printing station, and (d) receives length data from the length sensor. The processor then determines cut locations along the length of the log that define green body honeycomb structures to be cut, and directs the printing station to print one of the identification marks on a location along the length of said log corresponding to one of said structures defined between the cut locations.

The printing station preferably includes a non-contact ink jet type printer capable of printing a two-dimensional bar code in heat resistant ink on the side of the log. The print head is connected to a carriage assembly capable of moving it along the length of the log and adjusting the distance between the print head and the log. The length measuring sensor is preferably an optical sensor that is also connected to the carriage assembly, and the processor determines the length of the log by monitoring the distance that the carriage assembly moves the length measuring sensor from one end of the log to the other. Finally, the printing station includes a mark reader that optically scans the printed marks and relays the resulting image data to the processor, which compares the actual mark image with the mark intended to be printed, and determines whether the actual mark passes quality control.

The positioning station preferably includes a carrying tray coupled to an elevation mechanism. The carrying tray carries the log in a horizontal position. The elevation mechanism raises the tray and log into a printing position, and isolates it from vibration and other environmental influences that could adversely affect the printing of the bar code. The elevation mechanism has at least one optical sensor for monitoring the location of the log, and elevates the tray into a position where the apex of the log is at a desired distance from the print head and parallel to the path that the carriage assembly moves the print head. The carrying tray includes an identification code that is readable by an optical reader. An optical reader included within the printing station reads the identification code and transmits the identification code to the processor so that the particular log and its manufacturing history can be associated with the green body honeycomb structures ultimately cut from the log.

In another aspect, a method for marking a honeycomb log is provided, comprising the steps of associating an identification code with said log formed of ceramic-forming ingredients; determining multiple cut locations along a length of the log that define unfinished honeycomb structures that will result from cutting said log; generating a separate identification mark for each structure to be cut from said log, and printing one of said identification marks to a location along the longitudinal axis of said log corresponding to one of said structures.

By marking the log before the green body honeycomb structures are cut therefrom, the system and method of the invention advantageously produces individually marked green body honeycomb structures without the need for individually handling and marking them in their relatively fragile, pre-fired green body state. Additionally, the provision of an identification code on the carrying tray, and of an optical reader in the printing station capable of reading the identification code and transmitting it to the processor allows the processor to virtually track the initial manufacturing conditions of the log and to associate this early manufacturing history data with each of the green body honeycomb structures cut from the log.

According to another aspect, a method of manufacturing a honeycomb green body is provided, comprising the steps of extruding a honeycomb green body of ceramic-forming ingredients, placing the honeycomb green-body on a tray including an tray identification code, passing the honeycomb green-body on the tray through a dryer, and associating in a database, the tray identification code with manufacturing data selected from the group of batch data, extruder data, and dryer data.

DETAILED DESCRIPTION

Figure 1A:
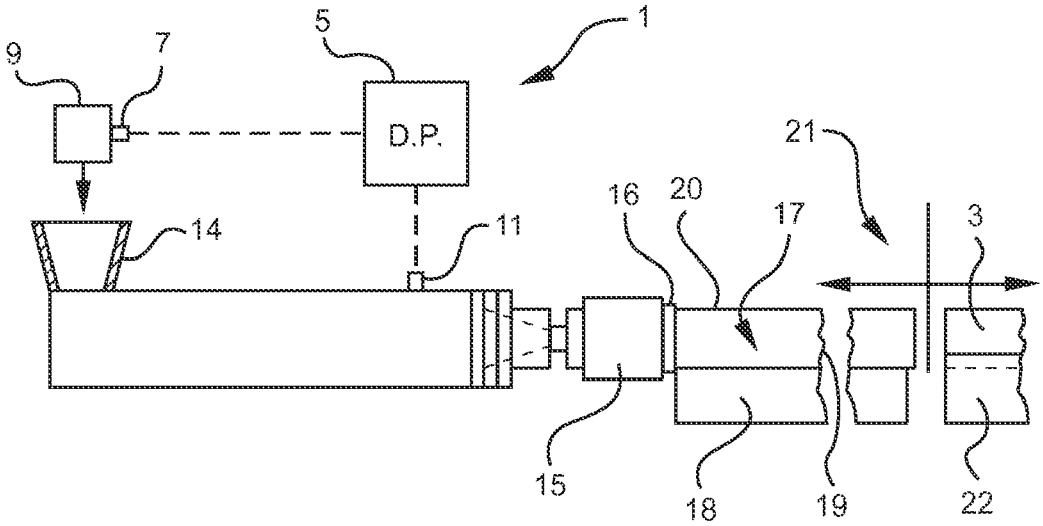
FIGS. 1A and 1B illustrate the application of the system of the invention prior to the marking of a green body log from which ceramic structures are ultimately cut from, wherein a plurality of sensors/inputs provided from the ceramic paste dispenser, the extruder, and/or the drying station relay the initial manufacturing history of the green body log to the digital processor of the system, and wherein the dried, green body log is loaded on to a conveyor tray of the system which has an optically readable identification tag that allows virtual identification of the extrusion upon arrival to the printing station of the system.

With reference now to FIG. 1A, wherein like numerals designate like components throughout all of the several figures, the system 1 of the invention initially monitors and records the manufacturing history of the log 3, which is typically an extrusion of ceramic-forming ingredients from which individual, green-body honeycomb structures are ultimately cut. However, it should be recognized that the present invention is applicable to log structures made by any method, such as casting, molding, etc. To this end, the system 1 includes a digital processor 5 connected to a data input point 7 associated with a dispenser 9 of ceramic precursor paste, and an additional data input point 11 located associated with the extruder 13 that forms the log 3. In the first stages of manufacture of the log 3, the dispenser 9 dispenses a preselected quantity of ceramic precursor paste in to an inlet 14 of the extruder. A mechanism (such as a ram or conveyor screw(s)) within the body of the extruder 13 forces the ceramic paste through a die assembly 15 having an extrusion die 16. The extrusion die 16 has a large number of closely spaced intersecting slots surrounded by an opening that create an extrudate 17 that is initially supported by an air-bearing tray 18. The resulting extrudate 17 includes a core formed from a honeycomb matrix of ceramic webs 19 surrounded by a skin 20 which may be, for example, cylindrical or elliptical (best seen in FIG. 3B). The air-bearing tray 18 supports the extrudate 17 as it is conveyed to a cutting station 21, which periodically cuts the extrudate into green body logs 3, which are individually loaded onto conveyor trays 22. A suitable tray is described in U.S. Pat. No. 5,406,058.

During these initial stages of extrusion manufacture, the data input point 7 may relay to the processor 5 data concerning the specific recipe (type and amount) of particulate ceramic batch ingredients and particular type and amount of liquid vehicle, organic binder and other processing ingredients used to form the ceramic precursor paste, and may include such items as the date, time, and ambient humidity, temperature conditions, and/or other relevant manufacturing data. The data input point 11 may relay data to the processor 5 concerning the identity of the extruder 13, the pressure of the ceramic precursor paste, extrusion rates, etc. as the batch is squeezed through the die assembly 15, the date that the extruder 13 was last subjected to routine maintenance, the temperature of the ceramic-forming paste during the extrusion operation, and/or other relevant extruder data. The data input points 7, 11 may include monitoring sensors that continuously and automatically relay such manufacturing data to the processor 5. Alternatively, such data may be manually inputted into the data input points 7, 11 by human operators or scanning operations. The processor records and associates the inputted batch manufacturing data with a particular batch of extrudate 17 via a time delay based on the extrusion rate.

Figure 1B:
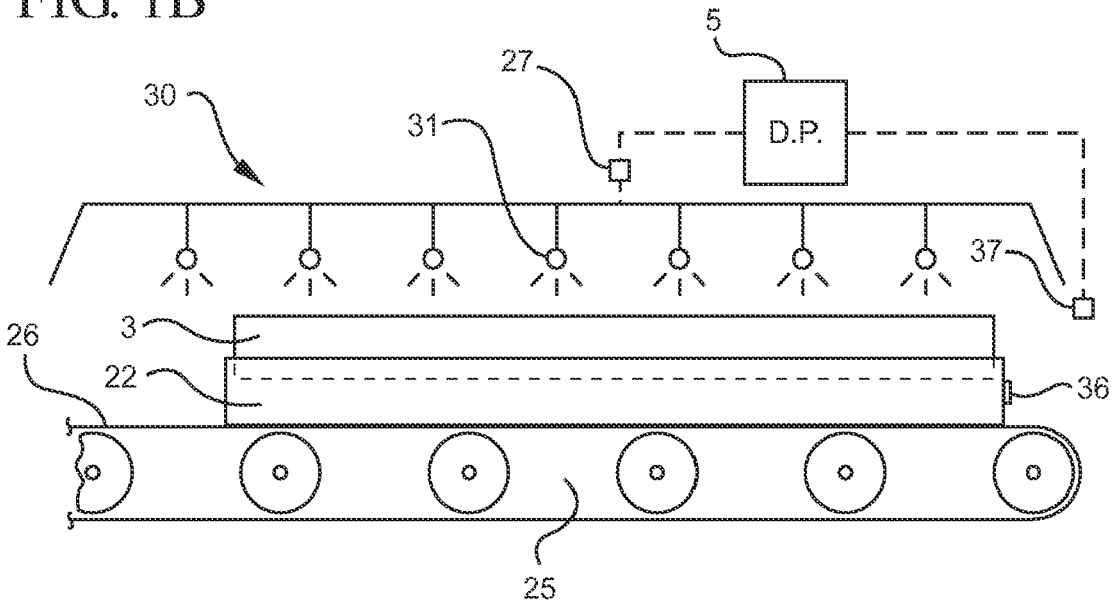

With reference now to FIG. 1B, a conveyor 25 having a moving belt 26 that transports the conveyor tray 22 that supports the newly formed green body log 3 to the drying station 30. The drying station 30 may includes a plurality of radiation emitters 31 capable of emitting a type and frequency of radiation (i.e. microwave, or radio-frequency) or of inducing a heat-creating electrical current that promotes the setting/gelling of the binder in the green body log 3 and removal of at least a portion of the liquid vehicle therefrom. A data input point 27 is connected both to the processor 5 and the control circuitry of the drying station 30. During the drying operation, the input 27 may relay data to the processor 5 concerning the drying conditions, type and frequency of drying radiation used in the drying station 30, the power levels used, the duration of the drying operation, the ambient temperature, date, and time of day, and ambient humidity. The processor 5 records this dryer data and associates it with the data received from the batch and extrusion data from input points 7, 11.

After the log 3 has been processed through the drying station 30, the tray 22 and log 3 are transferred to the printing station 40 of the system 1. The conveyor tray 22 includes a cradle portion 23 which has a semi-circular or semi-elliptical recess 34 (best seen in FIG. 2) along its longitudinal center line that is complementary in shape to the rounded bottom contour of the log 3. The tray may be isolated by a shock-absorbing material to isolate the log 3 from extraneous vibrations during the printing operation. Finally, the conveyor tray 22 includes an tray identification code 36 in the form of a tag or label on an end of the tray, and the drying station 30 includes a tray ID code reader 37 which allows the processor 5 to associate the manufacturing history generated from the data provided by the data input points 9, 11, and sensor 27 with a the tray and a specific log 3. Accordingly, the manufacturing data of at least one, and preferably all, selected from the group of the batch ingredient data, extruder data, and dryer data, may be associated in a database by the processor 5 to a specific log 3.

Figure 2:
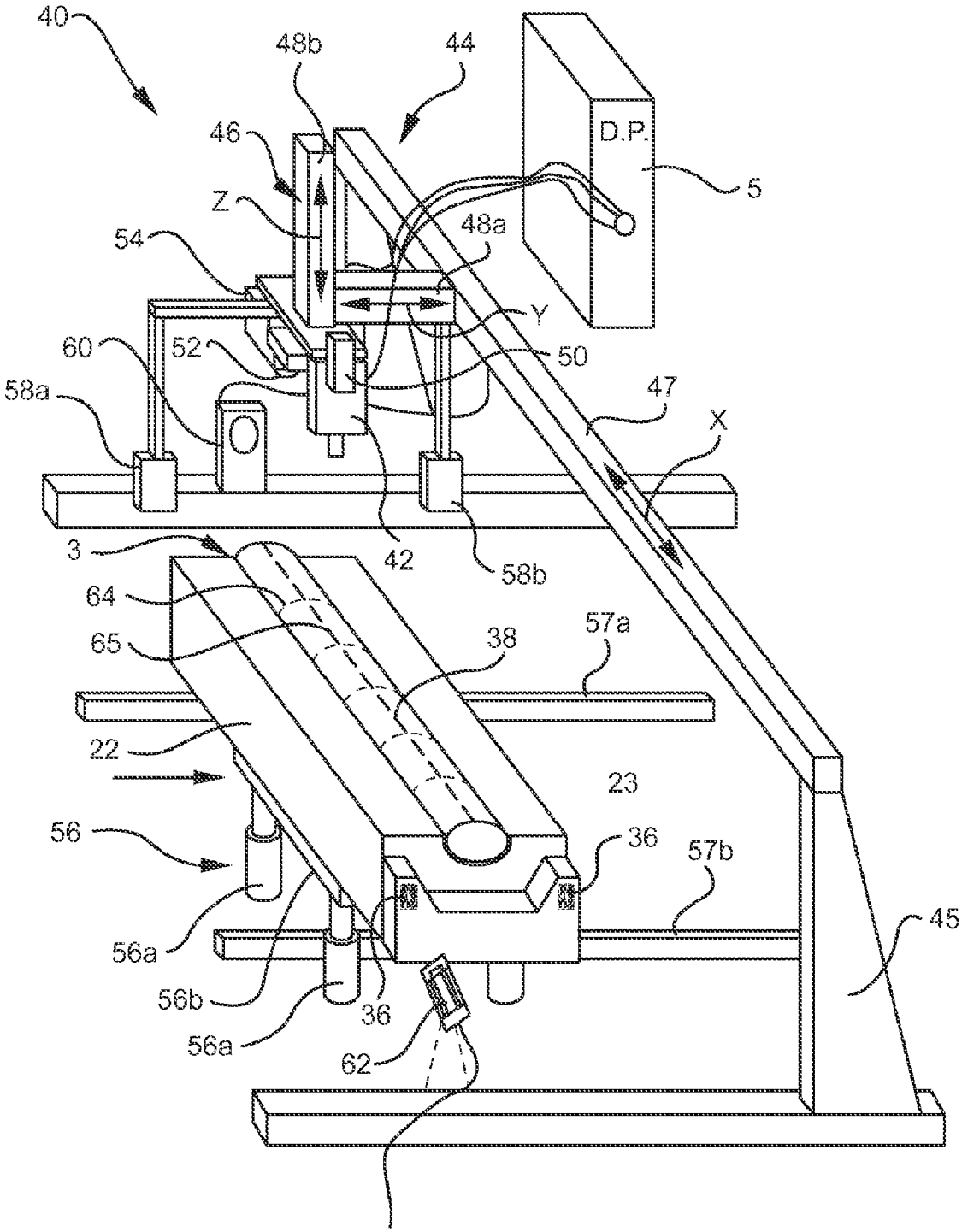
FIG. 2 is a simplified, perspective view of the printing station of the system, illustrating how the printing station determines the cut locations and mark locations (both of which are indicated in phantom) on the green body log prior to applying unique, identifying marks along the longitudinal axis of the log.

With reference now to FIG. 2, the log 3 is transported in the conveyor tray 22 to the elevation mechanism 56 of the printing station 40 of the system 1. The printing station 40 includes a non-contact print head 42, which is preferably an ink-jet print head capable of printing the combination of a two dimensional bar code and alphanumeric code on the side of the log 3. The ink is preferably a heat resistant ink. An example of a suitable print head is the XenJet QX500 printer available form Xennia Technology, Inc., having an office located in San Antonio, Tex. The print head 42 is mounted on a conveyor assembly 44 comprising a frame 45 and a carriage 46. The carriage 46 is movable along a rail aligned with an X-axis. The carriage 46 includes adjustably-movable, orthogonally disposed arms 48*a*, 48*b* connected to the printed head 42 and oriented along Y and Z axes, respectively. The carriage 46 further includes three electric servo-motors mechanically connected to the rail 47 and arms 48*a*, 48*b* via appropriate mechanical linkages (not shown), and electrically connected to a power source (also not shown) that is controlled by the processor 5, such that the processor 5 is able to actuate the servo-motors to position the print head 42 at a selected position along the X, Y and Z axes. While the printing operation is generally carried out along the X axis, the carriage 26 is capable of moving the print head 42 along the Y axis to maintain the printing along the apex 38 of the log 3 by compensating for any slight bending of the log 3.

Also mounted on the movable carriage 46 are a length measuring sensor 50, an identification mark camera 52, and a mark blotter 54. Each of these components is electrically connected to the processor 5. The length measuring sensor 50 enables the processor 5 to measures a length of the log 3, while the identification mark camera 52 determines whether the marks printed on the side of the log 3 by the print head 42 are machine legible and pass quality control standards. In the preferred embodiment, the length measuring sensor may be a simple photosensor capable of generating a signal indicating the presence or absence of a log directly under the carriage 46 from variations in the amplitude of light received, and the processor may to programmed to determine the length of the log 3 by scanning the sensor 50 along the X-axis rail 47 and noting the X-axis locations where the sensor commences a "log present" signal and a subsequent "log absent" signal. The identification mark camera 52 electronically photographs the actual marks printed by the print head 42, and transmits the resulting image signal to the processor 5. The processor 5 compares the image of the actual printed mark to an image of the mark intended to be printed and determines whether the printed mark passes or fails quality control standards. If the processor 5 determines that the printed mark fails quality control standards, it actuates the mark blotter 54, which prints over the defective mark.

The elevation mechanism 56 of the printing station 40 raises and orients the conveyor tray 22 such that the log 3 is in a horizontal position parallel to the X-axis rail 47 with its apex 38 directly under the print head 42. For this purpose, the elevation mechanism 56 includes a lift which lifts the tray off from a pair of slides 57*a*, 57*b*, wherein the lift is operated by a hydraulically powered units 56*a* which affords a smooth and easily controlled lifting action which allows the station operator to accurately place the log 3 in a printing position. The elevation mechanism 56 further includes shock and vibration-absorbing support 56*b* for isolating the log 3 from vibration present in the floor of the factory during the printing operation. Such supports may take the form of rubber or silicone pads between the lift and the tray. Log height sensors 58*a*, 58*b* are mounted on the frame 45 of the printing station in opposing relationship, while a position camera 60 is mounted at a middle point between the position sensors. Like the previously described length sensor 50, the log height sensors may be simple optical sensors that transmit a "log present" or "log not present" signal to the microprocessor, while the position camera 60 transmits a signal to the processor 5 indicative of the distance between the apex 38 of the log 3 and the print head 42. The station operator monitors the log position output of the processor 5 while operating the hydraulic unit that controls the elevation mechanism 56 in order to precisely place the log 3 in a printing position. Finally, the printing station 40 includes an optical reader 62 for reading the identification code 36 on the tray 22 and transmitting this code via an electric signal to the processor 5.

In operation, a log 3 is transported to the printing station 40 via the previously described tray 22. The lift of the elevation mechanism 56 are positioned under the tray 22. The optical reader 62 is scans the identification code 36 of the cradle portion, and the processor 5 assigns an identification number to the log 3 in the cradle, and relates the manufacturing history previously relayed to it from the data input points 7, 11, sensor 27 and 37 to the log 3. The station operator raises the elevator 56 via the previously mentioned hydraulic unit to raise the tray 22 until the log 3 is properly oriented within the station 40. During this step, the station operator monitors the output of the log height sensors 58*a*, 58*b* and position camera 60 via the processor 5 until the log is properly aligned with the X,Y and Z axes of the station 40 with the log apex 38 a proper distance from the print head 42.

The processor 5 next determines a length of the log 3 in the manner previously described by scanning the length measuring sensor 50 over the X-axis of the log 3 via the carriage 56. The processor 5 then determines the cut locations 64 along the X-axis of the log, and further computes mark locations 65 along the X-axis. The mark locations 65 are selected to be between the cut locations 64, and are preferably nearer one end of the green body honeycomb structures to be cut from the log 3. The processor 5 then assigns a unique identification mark 75 to each of the mark locations 65 (which, as shown in FIG. 3B, preferably comprises a combination of a two dimensional bar code 76 and an alphanumeric code 77). At the same time, the processor associates and records these unique identification marks 75 with the manufacturing history data of the log 3 in the data base.

The processor 5 next executes a printing operation by moving the print head 42 along the X-axis of the log 3 and printing a unique identification mark 75 at every mark location 65, for example, in a heat resistant ink. After each mark is printed, it is inspected by the identification mark camera 52. If the processor determines that the mark fails quality control, the mark blotter 54 is positioned over the defective mark and prints over it. The processor 5 then positions the print head 42 in a different position between the cut locations 64 defining the green body to be cut from the log 3, and re-actuates the print head to re-print the mark, which is re-inspected by the identification mark camera 52. Advantageously, the shock-absorbing characteristics of the isolator of the conveyor tray 22 effectively isolate the log from vibration during printing, which could otherwise result in the marring of the resulting printed identification marks 75.

Figure 3A:
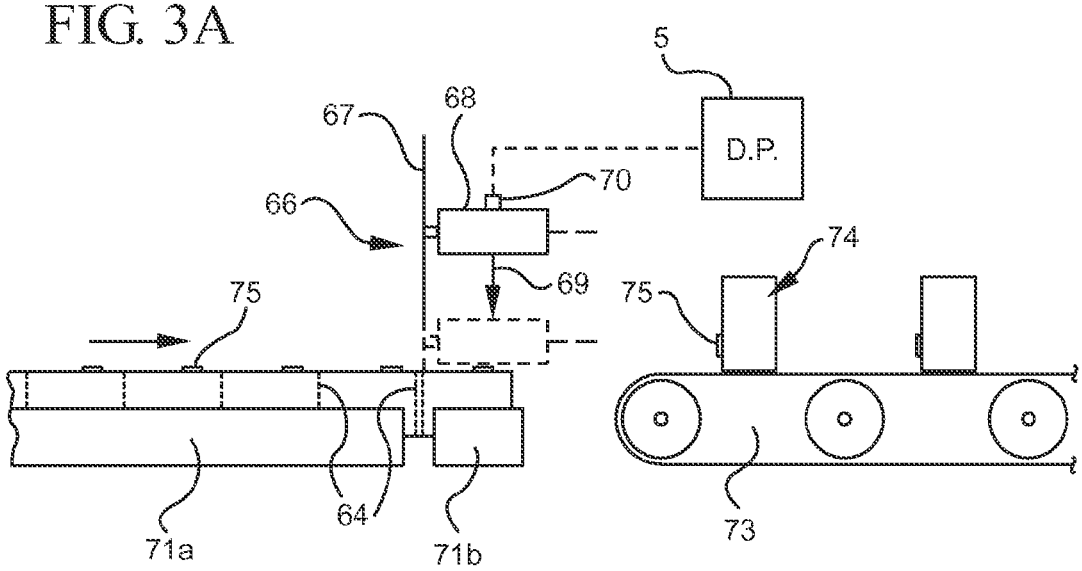
FIG. 3A illustrates the application of the system of the invention after the marking of the green body log, wherein sensors/inputs provided from the cutting station continue relay the manufacturing history of the log during and after the cutting of the marked log into individual, marked green body honeycomb structures.
Figure 3B:
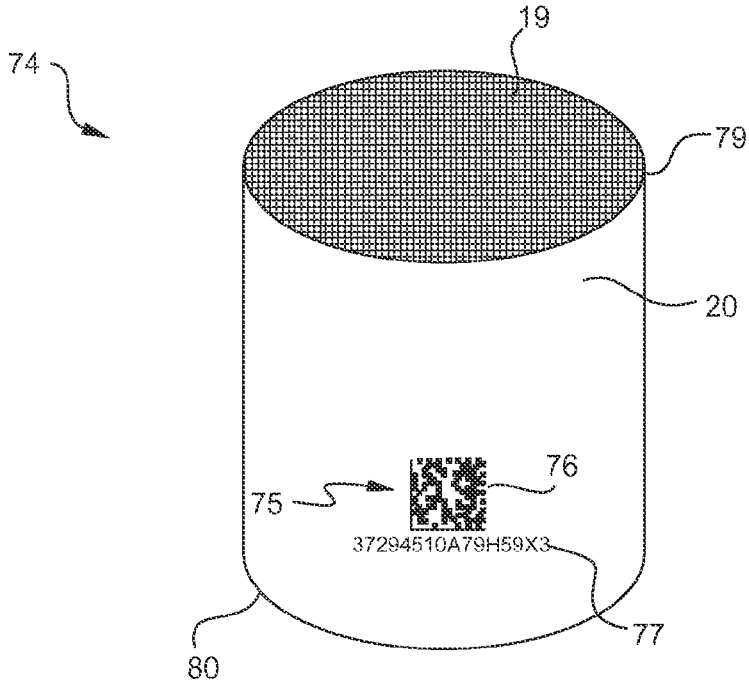
FIG. 3B is an enlarged perspective view of one of the marked, green body honeycomb structures that the system produces.

After the log 3 is printed, it is transported to a cutting station 66 as illustrated in FIG. 3A. Cutting station 66 has a rotary saw blade 67 that is oriented orthogonally to the longitudinal axis of the log as shown. The saw blade 67 is rotated by a motor 68 mounted on a lifting and lowering assembly 69. The system 1 includes a sensor 70 that continues to relay manufacturing history data to the digital processor 5, such as the blade ID, number of cuts the blade 67 has made, its rotational speed, ambient humidity conditions, etc. The log 3 is transferred to a pair of supports 71*a*, 71*b* that allow the saw blade 67 to cut completely through the log 3 at a cut location 64 disposed between the V-chuck supports 71*a*, 71*b*. In operation the marked log 3 is fed in the direction of arrow 72 until a cut location 64 is aligned with the saw blade 67. The saw blade 67 is lowered into the position shown in phantom, thereby cutting the log 3, and forming an individual green body honeycomb structure 74 bearing a unique identification mark 75. The processor 5 records all of the cutting data generated by the data transmitted by the sensor 70 as well as any other cutting data input from the cutting step, and associates it the log 3 and with each of the resulting individual cut green body honeycomb structures 74. The structures 74 are then transported away from the cutting station 66 such as by conveyor unit 73 to either storage or other manufacturing stations.

FIG. 3B illustrates an example of an individually marked green body honeycomb structure 74 produced by the marking system 1. As previously indicated, the mark 75 preferably formed from a combination of a two dimensional bar code 76 and an alphanumeric code 77 that uniquely identifies the structure so that the manufacturing history data stored a database by the processor 5 can be associated with it. A two dimensional bar code 77 can be used instead of a one dimensional bar code as a substantial portion of a two dimensional bar code can be obliterated without losing the identification code embedded within it. The provision of an alphanumeric code 77 in the mark 75 that stores the identifying code in human readable form can be convenient for use by human handlers.

Different modifications, additions, and variations of this invention may become evident to the persons in the art. All such variations, additions, and modifications are encompassed within the scope of this invention, which is limited only by the appended claims, and the equivalents thereto.

What is claimed is:

1. A method for marking a honeycomb log, comprising the steps of:

associating an identification code with said log formed of ceramic-forming ingredients;

determining multiple cut locations along a length of the log that define unfinished honeycomb structures that will result from cutting said log;

generating a separate identification mark for each structure to be cut from said log;

printing one of said identification marks onto a location along the longitudinal axis of said log corresponding to one of said structures;

determining whether at least one identification mark passes or fails quality control standards; and if an identification mark is determined to fail quality control standards, printing over said identification mark.

2. The method of claim 1, further including the step of processing information in said identification marks and information in said identification code of said log.

3. The method of claim 1, further including the step of determining the length of said log prior to determining said cut locations.

4. The method of claim 3, wherein said identification marks are applied to said log at said station by a printer that is movable along a path parallel to a longitudinal axis of said log.

5. The method of claim 4, further including the step of determining an apex of said log, and printing said identification marks along said apex of said log.

6. The method of claim 4, further including the step of determining a center line of the apex, and printing said identification marks along said center line of the log.

7. The method of claim 3, wherein said log is conveyed in a tray having a conveyor identification code, and further including the step of processing information in said conveyor identification code and information in said identification code of said log.

8. The method of claim 3, wherein said information processing step includes recording an association between said information in said identification marks and information in said identification code of said log.

9. The method of claim 1, wherein a plurality of identification marks are printed on said log.

10. The method of claim 1, wherein said identification marks are bar codes.

11. The method of claim 1, wherein determining whether at least one identification mark passes or fails quality control standards comprises comparing at least one identification mark to an image of a mark intended to be printed.

12. A method of manufacturing a honeycomb green body, comprising the steps of:

extruding a honeycomb green body log of ceramic-forming ingredients, placing the honeycomb green-body on a tray including a tray identification code, passing the honeycomb green-body on the tray through a dryer, associating in a database, the tray identification code with manufacturing data selected from the group of batch data, extruder data, and dryer data, marking a plurality of identification marks on the honeycomb green body log, determining whether at least one identification mark passes or fails quality control standards and if an identification mark is determined to fail quality control standards, printing over said identification mark.

13. The method of claim 12 further comprising a step of associating the identification marks with the tray identification code.

14. The method of claim 12 further comprising a step of associating the identification marks with the manufacturing data.

15. The method of claim 12, wherein determining whether at least one identification mark passes or fails quality control standards comprises comparing at least one identification mark to an image of a mark intended to be printed.

* * * * *